US008744327B2

(12) United States Patent
Suzuki et al.

(10) Patent No.: US 8,744,327 B2
(45) Date of Patent: Jun. 3, 2014

(54) MEDIA STRIPPER, AND FIXING DEVICE AND IMAGE FORMING APPARATUS EMPLOYING SAME

(75) Inventors: Naoto Suzuki, Kanagawa (JP); Takeshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 254 days.

(21) Appl. No.: 13/215,717

(22) Filed: Aug. 23, 2011

(65) Prior Publication Data

US 2012/0051805 A1 Mar. 1, 2012

(30) Foreign Application Priority Data

Aug. 25, 2010 (JP) ..... 2010-188115

(51) Int. Cl.
*G03G 15/20* (2006.01)

(52) U.S. Cl.
USPC ..... 399/323

(58) Field of Classification Search
USPC ..... 399/323; 271/307, 900, 312, 313
See application file for complete search history.

(56) References Cited

U.S. PATENT DOCUMENTS

| | | | | |
|---|---|---|---|---|
| 4,408,757 | A * | 10/1983 | Yarm | 271/900 |
| 7,228,096 | B2 * | 6/2007 | Yamada | 399/323 |
| 7,974,560 | B2 * | 7/2011 | Nakajima et al. | 399/323 |
| 2006/0088346 | A1 * | 4/2006 | Swanson | 399/323 |
| 2006/0257183 | A1 | 11/2006 | Ehara et al. | |
| 2009/0274477 | A1 | 11/2009 | Okamoto et al. | |
| 2009/0274494 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2009/0297199 | A1 | 12/2009 | Yamashina et al. | |
| 2010/0014898 | A1 * | 1/2010 | Nakajima | |
| 2010/0239292 | A1 | 9/2010 | Fujita et al. | |
| 2010/0316397 | A1 | 12/2010 | Kudou et al. | |

(Continued)

FOREIGN PATENT DOCUMENTS

| | | | |
|---|---|---|---|
| CN | 1208870 | A | 2/1999 |
| CN | 1303031 | A | 7/2001 |

(Continued)

OTHER PUBLICATIONS

U.S. Appl. No. 13/205,005, filed Aug. 8, 2011, Hirose, et al.

(Continued)

*Primary Examiner* — Susan Lee
(74) *Attorney, Agent, or Firm* — Oblon, Spivak, McClelland, Maier & Neustadt, L.L.P.

(57) ABSTRACT

A media stripper for use with a pair of first and second, opposed rotary members includes a stripper finger and a rotation restriction mechanism. The stripper finger has an operational edge thereof disposed adjacent to the first rotary member to strip a recording medium from the first rotary member. The stripper finger is rotatable around a pivot axis parallel to a rotation axis of the first rotary member either in a first rotational direction in which the operational edge approaches the first rotary member, or in a second rotational direction in which the operational edge approaches the second rotary member, so as to establish an operational position thereof relative to the first rotary member. The rotation restriction mechanism is disposed for contact with the stripper finger to restrict rotation of the stripper finger in the second rotational direction upon establishment of the operational position of the stripper finger.

19 Claims, 9 Drawing Sheets

(56) References Cited

U.S. PATENT DOCUMENTS

| | | | |
|---|---|---|---|
| 2011/0164904 | A1 | 7/2011 | Hirose et al. |
| 2011/0182609 | A1 | 7/2011 | Hasegawa et al. |
| 2011/0217091 | A1 | 9/2011 | Hirose et al. |

FOREIGN PATENT DOCUMENTS

| | | | | |
|---|---|---|---|---|
| JP | 60076781 | A | * | 5/1985 |
| JP | 04077777 | A | * | 3/1992 |
| JP | 2005-156669 | | | 6/2005 |
| JP | 2005-156670 | | | 6/2005 |
| JP | 2005-156671 | | | 6/2005 |
| JP | 2005-157179 | | | 6/2005 |
| JP | 2006-11193 | | | 1/2006 |
| JP | 3780881 | | | 3/2006 |
| JP | 2006-126876 | A | | 5/2006 |
| JP | 2006-153937 | A | | 6/2006 |
| JP | 2006-227349 | A | | 8/2006 |
| JP | 2007034019 | A | * | 2/2007 |
| JP | 2007-233158 | | | 9/2007 |
| JP | 2008-65042 | | | 3/2008 |
| JP | 2008-83515 | | | 4/2008 |
| JP | 2008-139445 | A | | 6/2008 |
| JP | 4210486 | | | 10/2008 |
| JP | 2009-31759 | | | 2/2009 |
| JP | 4287707 | | | 4/2009 |
| JP | 4362701 | | | 8/2009 |
| JP | 4396784 | | | 10/2009 |
| JP | 2010-26234 | | | 2/2010 |
| JP | 2010026234 | A | * | 2/2010 |
| JP | 2010-79219 | | | 4/2010 |
| JP | 4695976 | | | 3/2011 |

OTHER PUBLICATIONS

U.S. Appl. No. 13/067,809, filed Jun. 28, 2011.
U.S. Appl. No. 13/067,380, filed Jun. 27, 2011.
U.S. Appl. No. 12/986,425, filed Jan. 7, 2011, Takashi Seto, et al.
Office Action issued on Jan. 28, 2014, in counterpart Japanese Appln No. 2010-188115 (2 pages).
Combined Office Action and Search Report issued Nov. 13, 2013 in Chinese Patent Application No. 201110238794.1 (with English translation of category of cited documents).

* cited by examiner

MEDIA STRIPPER, AND FIXING DEVICE AND IMAGE FORMING APPARATUS EMPLOYING SAME

CROSS-REFERENCE TO RELATED APPLICATIONS

This patent application is based on and claims priority pursuant to 35 U.S.C. §119 to Japanese Patent Application No. 2010-188115, filed on Aug. 25, 2010, in the Japan Patent Office, the entire disclosure of which is hereby incorporated herein by reference.

BACKGROUND OF THE INVENTION

1. Field of the Invention

The present invention relates to a media stripper, and a fixing device and an image forming apparatus employing the same, and more particularly, to a media stripper for use with a pair of rotary members disposed opposite each other to form a nip therebetween, and a fixing device and an electrophotographic image forming apparatus, such as a photocopier, facsimile machine, printer, plotter, or multifunctional machine, employing such a media stripper.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One such fixing device includes a multi-roller, belt-based fuser assembly that employs an endless, flexible fuser belt entrained around multiple rollers, one of which is equipped with an internal heater, such as a radiant halogen heater, to heat the length of the fuser belt through contact with the heated roller. The fuser belt is paired with a pressure roller pressed against the outer surface of the fuser belt to form a fixing nip therebetween, at which a toner image is fixed in place with heat from the fuser belt and pressure from the pressure roller.

Owing to the fuser belt which exhibits a relatively low heat capacity and therefore can be swiftly heated, the belt-based fuser assembly eliminates the need for keeping the heater in a sufficiently heated state when idle, resulting in shorter start-up time and smaller amounts of energy wasted during standby, as well as a relatively compact size of the fuser assembly.

One important factor that determines imaging quality of a fixing device is the ability to properly convey a recording medium through the fixing nip without causing the recording medium to wrap around the rotary fixing member. Media wraparound occurs where the toner image heated through the fixing nip becomes sticky and thus adheres to the surface of the fixing member upon exiting the fixing nip. If not corrected, a recording medium wrapping around the fixing member would cause jam or other conveyance failure in the fixing nip.

For obtaining a fixing process with high immunity against media wraparound and concomitant conveyance failure, a fixing device may use a fuser roller or belt coated with a release agent such as fluorine resin where it contacts a heated, sticky toner image in the fixing nip, while equipped with a media stripping mechanism that allows a recording medium to properly separate from the fuser member at the exit of the fixing nip.

For example, in multi-color printing, a non-contact media stripping mechanism is used to strip a recording medium without touching a fuser roller, which often includes a cylindrical body covered by an outer elastic layer of silicone rubber or the like with a coating of oil or fluorine resin deposited thereon. Using the non-contact media stripper prevents the rubber-covered fuser member from damage due to continuous contact with the media stripping mechanism, which would otherwise result in streaks or other imperfections in a resulting image.

One example of such non-contact media stripper is a stripping plate having a thin-edged, wedge-shaped configuration with its thin operating edge directed toward a fuser member to engage a leading edge of a recording medium to strip it off the fuser member. The stripping plate may be provided with a flange or positioning mechanism, such as one that can contact the fuser member outboard of a maximum compatible width of recording medium, so as to maintain the operating edge in position spaced apart from the rotary member. Maintaining a spacing or gap between the stripping mechanism and the fuser member prevents damage to the fuser member as well as undesired offset or re-transfer of toner adherent, if any, from the stripping mechanism to the fuser member to potentially smear and degrade a resulting image.

BRIEF SUMMARY OF THE INVENTION

Exemplary aspects of the present invention are put forward in view of the above-described circumstances, and provide a novel media stripper for use with a pair of first and second, opposed rotary members disposed opposite each other to form a nip therebetween through which a recording medium is conveyed as the rotary members rotate together.

In one exemplary embodiment, the novel media stripper includes a stripper finger and a rotation restriction mechanism. The stripper finger has an operational edge thereof disposed adjacent to the first rotary member to strip the recording medium from the first rotary member. The stripper finger is rotatable around a pivot axis parallel to a rotation axis of the first rotary member either in a first rotational direction in which the operational edge approaches the first rotary member, or in a second rotational direction in which the operational edge approaches the second rotary member, so as to establish an operational position thereof relative to the first rotary member. The rotation restriction mechanism is disposed for contact with the stripper finger to restrict rotation of the stripper finger in the second rotational direction upon establishment of the operational position of the stripper finger.

Other exemplary aspects of the present invention are put forward in view of the above-described circumstances, and provide a novel fixing device.

Still other exemplary aspects of the present invention are put forward in view of the above-described circumstances, and provide a novel image forming apparatus.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
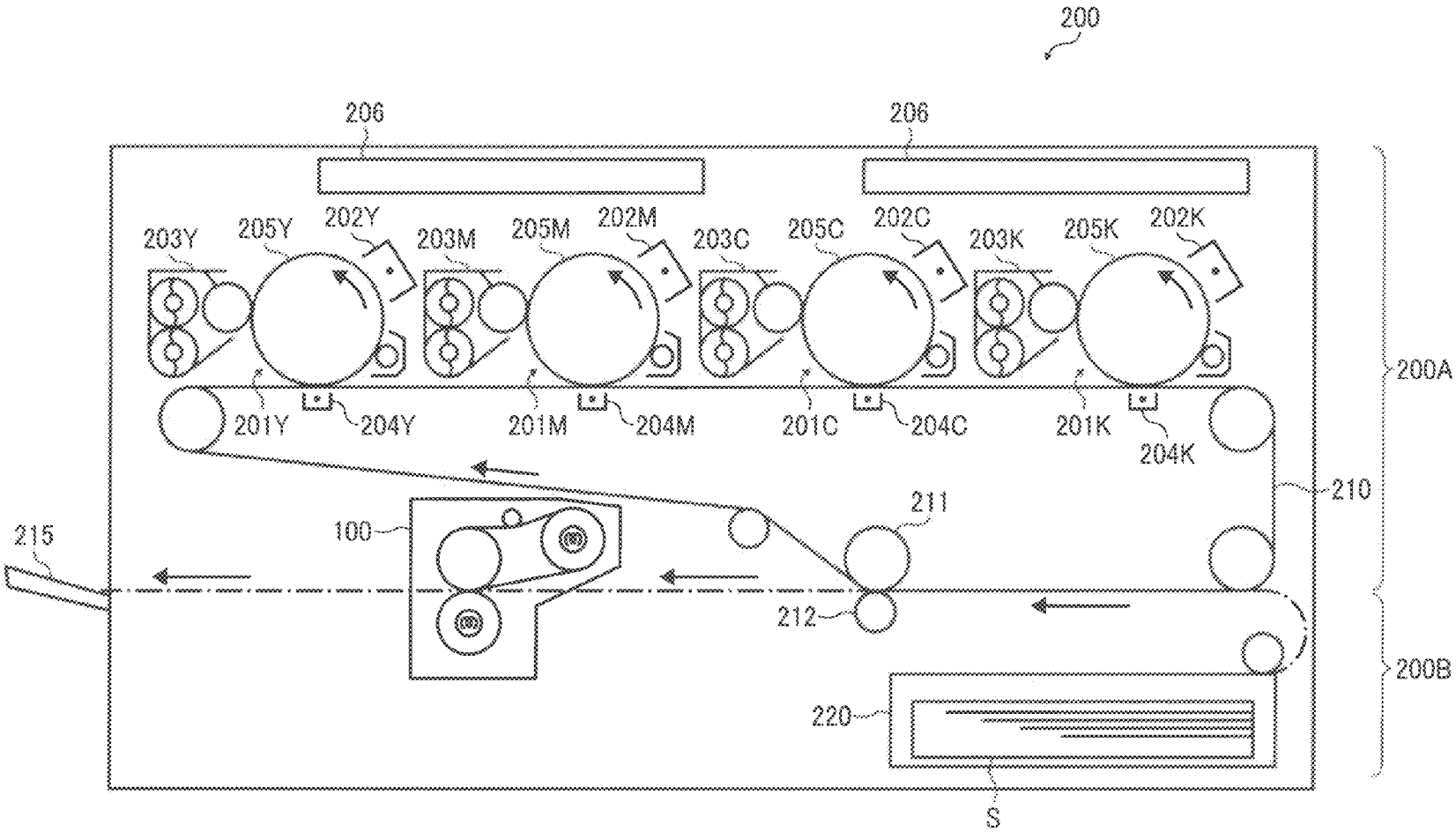
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 200 incorporating a fixing device 100 according to this patent specification.

As shown in FIG. 1, the image forming apparatus 200 is a high-speed, digital color imaging system that can print a color image on a recording medium such as a sheet of paper S according to image data, consisting of a generally upper, printer section 200A, and a generally lower, sheet feeding section 200B combined together to form a freestanding unit, on top of which may be deployed an appropriate image scanner that allows for capturing image data from an original document.

The printer section 200A comprises a tandem color printer that forms a color image by combining images of yellow, magenta, and cyan (i.e., the complements of three subtractive primary colors) as well as black, consisting of four electrophotographic imaging stations 201Y, 201M, 201C, and 201K arranged in series substantially laterally along the length of an intermediate transfer belt 210, each forming an image with toner particles of a particular primary color, as designated by the suffixes "Y" for yellow, "M" for magenta, "C" for cyan, and "K" for black.

Each imaging station 201 includes a drum-shaped photoconductor 205 rotatable counterclockwise in the drawing, having its outer, photoconductive surface exposed to an exposure device 206 while surrounded by various pieces of imaging equipment, such as a charging device 202, a development device 203 accommodating toner of the associated primary color, an electrically biased, primary transfer device 204, a cleaning device for the photoconductive surface, etc., which work in cooperation to form a primary toner image on the photoconductor 205 for subsequent transfer to the intermediate transfer belt 210 at a primary transfer gap defined between the photoconductive drum 205 and the primary transfer device 204.

The intermediate transfer belt 210 is trained around multiple support rollers to rotate clockwise in the drawing, passing through the four primary transfer gaps sequentially to carry thereon a multi-color toner image toward a secondary transfer nip defined between a secondary transfer roller 212 and a backup roller 211, at which the toner image is transferred to a recording sheet S fed from the sheet feeding section 200B.

The sheet feeding section 200B includes one or more sheet trays 220 each accommodating a stock of recording sheets S, as well as a sheet conveyance mechanism, including multiple rollers, guide plates, etc., which together define a sheet conveyance path for conveying a recording sheet S from the sheet tray 220, then through the secondary transfer nip, and then through the fixing device 100 which fixes the toner image in place on the recording sheet S with heat and pressure, and finally to a sheet stacker 215 disposed outside the apparatus body to accommodate a finalized print for user pickup. The sheet conveyance path extends substantially laterally from the secondary transfer nip to the fixing device 100.

During operation, each imaging station 201 rotates the photoconductor drum 2 counterclockwise in the drawing to forward its photoconductive surface to a series of electrophotographic processes, including charging, exposure, development, transfer, and cleaning, in one rotation of the photoconductor drum 205.

First, the photoconductive surface is uniformly charged to a specific polarity by the charging device and subsequently exposed to a modulated laser beam emitted from the exposure device 206. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer device that electrostatically transfers the primary toner image to the intermediate transfer belt 210 through the primary transfer gap.

As the multiple imaging stations 201 sequentially produce toner images of different colors at the four transfer nips along the belt travel path, the primary toner images are superimposed one atop another to form a single multicolor image on the moving surface of the intermediate transfer belt 210 for subsequent entry to the secondary transfer nip between the secondary transfer roller 212 and the backup roller 211.

Meanwhile, the sheet conveyance mechanism picks up a lowermost recording sheet S from the sheet stack in the sheet tray 220, and then advances it in sync with the movement of the intermediate transfer belt 210 to the secondary transfer nip.

At the secondary transfer nip, the multicolor image is transferred from the belt 210 to the recording sheet S, which is then introduced into the fixing device 100 to fix the toner image in place under heat and pressure. The recording sheet S after fixing is forwarded along the sheet conveyance path to the sheet stacker 215 for stacking outside the apparatus body, which completes one operational cycle of the image forming apparatus 200.

Figure 2:
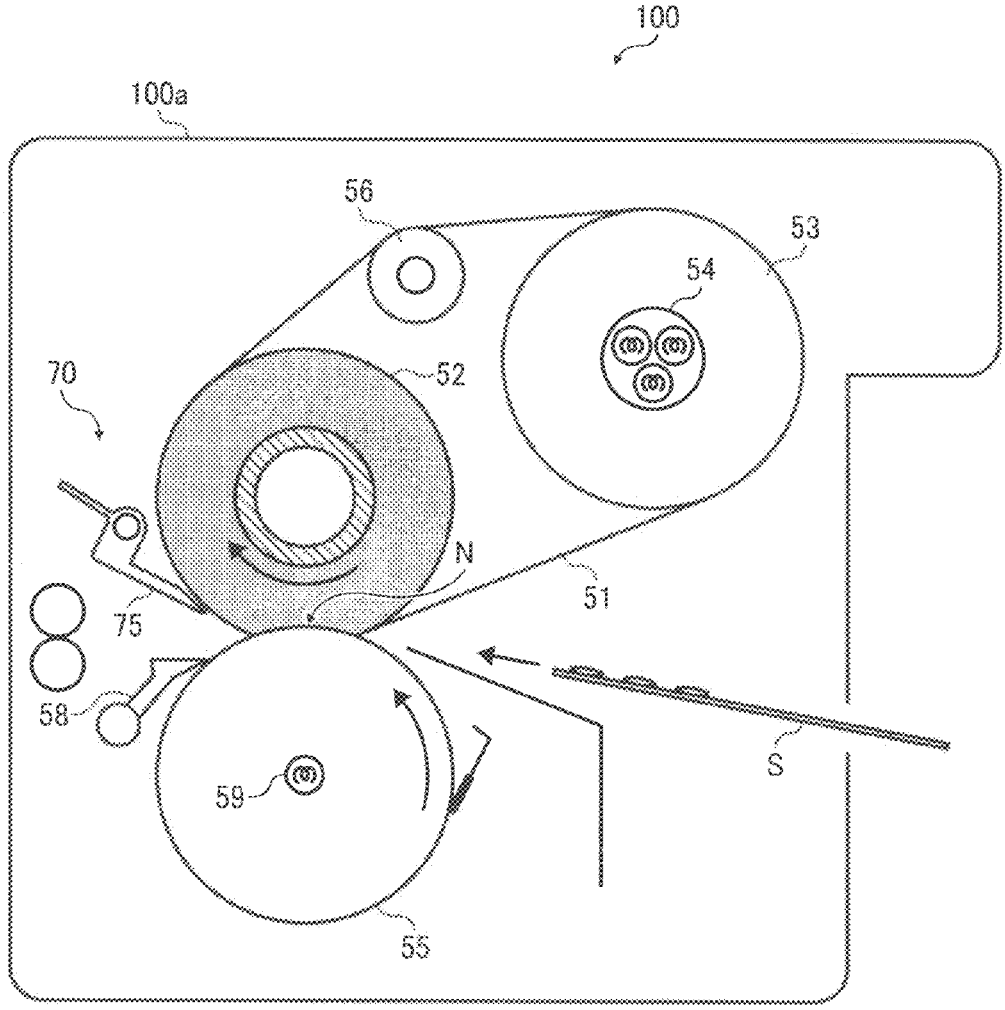
FIG. 2 is an end-on, axial cutaway view schematically illustrating the fixing device according to one embodiment of this patent specification.

FIG. 2 is an end-on, axial cutaway view schematically illustrating the fixing device 100 incorporated in the image forming apparatus 200 according to one embodiment of this patent specification.

As shown in FIG. 2, the fixing device 100 includes a rotary fuser belt 51 entrained tightly around a fuser roller 52 and a heat roller 53, as well as a rotary pressure roller 55 pressed against the fuser roller 52 through the fuser belt 51 to form a fixing nip N therebetween, all of which extend in an axial, longitudinal direction perpendicular to the sheet of paper on which the FIG. is drawn, while accommodated in an enclosure housing 100*a* of the fixing device 100.

In the present embodiment, the fuser belt 51 comprises an endless, multilayered belt formed of a substrate of stiff material upon which is deposited at least an outer layer of elastic material. For example, the fuser belt 51 may be a bi-layered belt consisting of a substrate of nickel, stainless steel, or polyimide, coated with an elastic layer of silicone rubber deposited thereupon. A tension roller 56 is held against the belt 51 inside the belt loop to impart proper tension to the belt 51 between the belt supporting rollers 52 and 53.

The fuser roller 52 comprises a metal-cored rubber roller, approximately 90 mm in diameter, for example, consisting of a cylindrical core of metal covered by an elastic layer of silicone rubber or the like deposited thereupon. To reduce warm-up time, sponged silicone rubber may be used to form the outer elastic layer, which does not absorb excessive heat to cause conductive heat loss where the rubber roller 52 contacts the fuser belt 51.

The heat roller 53 comprises a hollow roller of thermally conductive metal, such as iron or aluminum, which accommodates a radiant halogen heater 54 or the like in its hollow interior to supply heat to the fuser assembly. Another heating mechanism, such as an electromagnetic induction heater (IH), may also be employed instead of a radiant heater. Operation of the heater 54 may be controlled according to readings of a thermometer or thermistor disposed adjacent to the heat roller 53 to detect temperature of the fuser belt 51.

The pressure roller 55 comprises a metal-cored rubber roller, approximately 80 mm in diameter, for example, consisting of a hollow rotatable core of metal, such as iron, aluminum, or the like, covered by an elastic layer of silicone rubber or the like deposited thereupon. The pressure roller 55 is provided with a biasing mechanism that presses the pressure roller 55 against the fuser roller 52 via the fuser belt 51 to establish an adjustable, constant pressure in the fixing nip N, i.e., moves the pressure roller 55 toward the fuser roller 52 to increase the nip pressure, and moves the pressure roller 55 away from the fuser roller 52 to reduce the nip pressure. An optional, dedicated heater 59 may be provided in the hollow interior of the pressure roller 55, so as to heat the pressure roller 55 to a desired temperature during fixing or where required.

Although the present embodiment depicts an endless fuser belt entrained around multiple rollers, alternatively, instead, the rotary fuser member 51 may be configured as any suitable rotatable member, such as an internally heated, hollow cylindrical roller, or a looped piece of thin film rotatable around a heated roll or pipe. Also, although the present embodiment depicts a hollow cylindrical pressure roller, alternatively, instead, the rotary pressure member 55 may be configured as an endless looped belt or other suitable rotatable member. Further, although the present embodiment depicts a motor-driven fuser roller to drive the rotary fixing members, alternatively, a rotary motor may be provided to a pressure roller, a heat roller, or other suitable portion of the fixing assembly.

During operation, the fuser roller 52 rotates in a given direction of rotation (i.e., clockwise in FIG. 2) to rotate the fuser belt 51 in the same rotational direction, which in turn rotates the pressure roller 55 held in contact with the rotating belt 51. The fuser belt 51 during rotation is kept in proper tension with the tension roller 56 pressing against the belt 51 from inside of the belt loop, while having its circumference heated with the heat roller 53 to a given processing temperature sufficient for fusing toner at the fixing nip N.

In this state, a recording sheet S bearing an unfixed, powder toner image T enters the fixing device 100, with its previously imaged side facing the fuser belt 51 and opposite side brought into contact with the pressure roller 55. As the rotary fixing members 51 and 55 rotate together, the recording sheet S passes through the fixing nip N in a sheet conveyance direction (from right to left in FIG. 2), wherein heat from the fuser belt 51 causes toner particles to fuse and melt, while pressure from the pressure roller 55 causes the molten toner to settle onto the sheet surface, thereby fixing the toner image in place on the recording sheet S.

With continued reference to FIG. 2, the fixing device 100 is shown including a sheet stripper 70 disposed facing the fuser belt 51 downstream from the fixing nip N in the sheet conveyance direction. The sheet stripper 70 includes a stripper finger or plate 75 having an operational edge thereof disposed adjacent to, and apart from, the fuser belt 51 to strip the recording sheet S from the fuser belt 51 at the exit of the fixing nip N. Also, a contact sheet stripper 58 may be provided facing the pressure roller 55 downstream from the fixing nip N in the sheet conveyance direction, which has an operational edge thereof disposed in contact with the pressure roller 55 to prevent the recording sheet S from adhering to or wrapping around the pressure roller 55 at the exit of the fixing nip N.

The operational edge of the stripper finger 75 is positioned with a slight spacing or gap from the fuser belt 51, so as to prevent potential damage caused by the finger operational edge touching and scratching the belt surface. Also, the finger operational edge is sufficiently close to the exit of the fixing nip N for preventing the outgoing sheet S from being excessively heated by prolonged contact with the fuser belt 51, which would otherwise result in imaging defects, such as orange-peel texture, blistering, excessive gloss, hot offset or undesired transfer of toner, and the like.

For example, the operational edge of the stripper finger 75 may be positioned 5 mm away from the exit of the fixing nip N, and 2 mm away from the pressure roller 55, where the fuser roller 52 has a diameter of 90 mm, and the pressure roller 55 a diameter of 80 mm, yielding a fixing nip N with a length ranging from 25.5 mm to 26 mm in the sheet conveyance direction.

During operation, where the recording sheet S after fixing adheres to the fuser belt 51 upon exiting the fixing nip N, the sheet stripper 70 allows separation of the outgoing sheet S from the belt surface as the stripper finger 75 engages the leading edge of the sheet S to force it away from the fuser belt 51. On the other hand, where the recording sheet S after fixing adheres to the pressure roller 55 upon exiting the fixing nip N, the sheet stripper 58 allows separation of the outgoing sheet S from the roller surface by engaging the leading edge of the sheet S to force it away from the pressure roller 55. Provision of the sheet strippers 70 and 58 to the rotary fixing members 51 and 55, respectively, thus allows for proper conveyance of the recording sheet S immediately downstream from the fixing nip N, which can then proceeds to a suitable guide member to exit the fixing device 100.

As used herein, the term "recording medium" herein includes any material, such as a sheet of paper, subjected to imaging process including passage through a nip defined between a pair of opposed rotary members disposed opposite each other. Also, the term "stripping" is used to describe removal of a recording medium from a rotary member forming a nip, and the term "stripper" or "stripper finger" refers to any device, such as wedge, blade, plate, or the like, held in contact with, or spaced apart from a rotary member forming a nip to strip a recording medium from the rotary member, as set forth herein.

Figure 3:
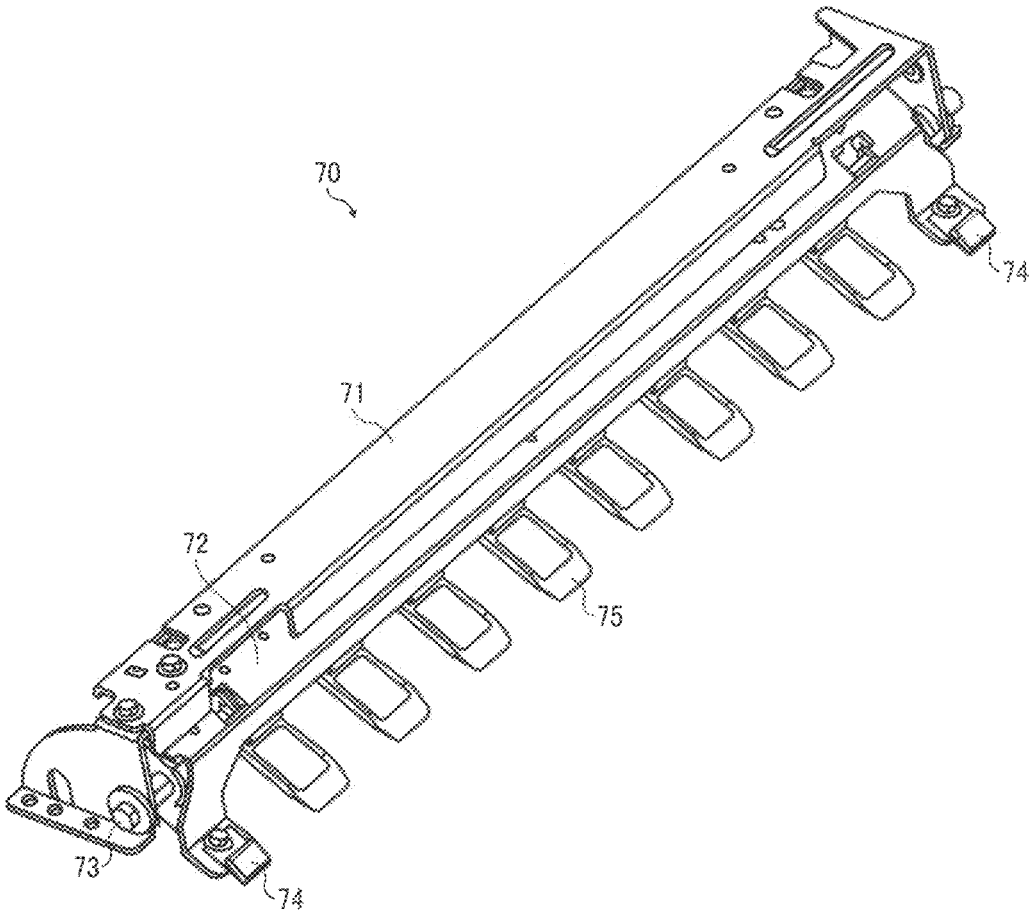
FIG. 3 is a perspective view schematically illustrating a sheet stripper included in the fixing device of FIG. 2.

FIG. 3 is a perspective view schematically illustrating the sheet stripper 70 included in the fixing device 100.

As shown in FIG. 3, the sheet stripper 70 comprises an elongated assembly including multiple stripper fingers 75 connected to a rotatable shaft 73 supported on an elongated stay 72, which is in turn rotatably supported via the shaft 73 on a stationary frame 71 to be affixed to the enclosure housing 100*a* of the fixing device 100. Also included in the sheet stripper 70 is a pair of positioning flanges 74 disposed at opposed longitudinal ends of the stay 72, each pointing outward from the shaft 73 beyond the stripper fingers 75. Although relatively narrow eight stripper fingers are depicted in FIG. 3, the size, shape, number, or arrangement of stripper fingers is not limited to the embodiment described herein. For example, instead of multiple stripper fingers 75, the sheet stripper 70 may be configured with only a single stripper finger 75, in which case the stripper finger 75 may be an elongated plate extending along a length of the supporting shaft 73.

The sheet stripper 70 is mounted in the fixing device 100 with the shaft 73 extending along the fuser roller 52, so that the stripper fingers 75 are arranged in series in the axial, longitudinal direction of the fuser roller 52, while the pair of positioning flanges 74 contacts the fuser belt 51 outboard of a width of the recording sheet S to form a spacing or gap between the operational edge of the stripper finger 75 and the fuser belt 51.

Additionally, the sheet stripper 70 may have a biasing member, such as a spring, disposed between the frame 71 and the stay 72 to bias the stay 71 toward the fuser assembly, so that the flanges 74 slide against the fuser belt 51 rotating during operation. With the supporting stay 72 thus biased against the fuser belt 51, each stripper finger 75 is properly positioned with respect to the fuser belt 51 with a desired, precise spacing between its operational edge and the fuser belt 51.

Figure 4:
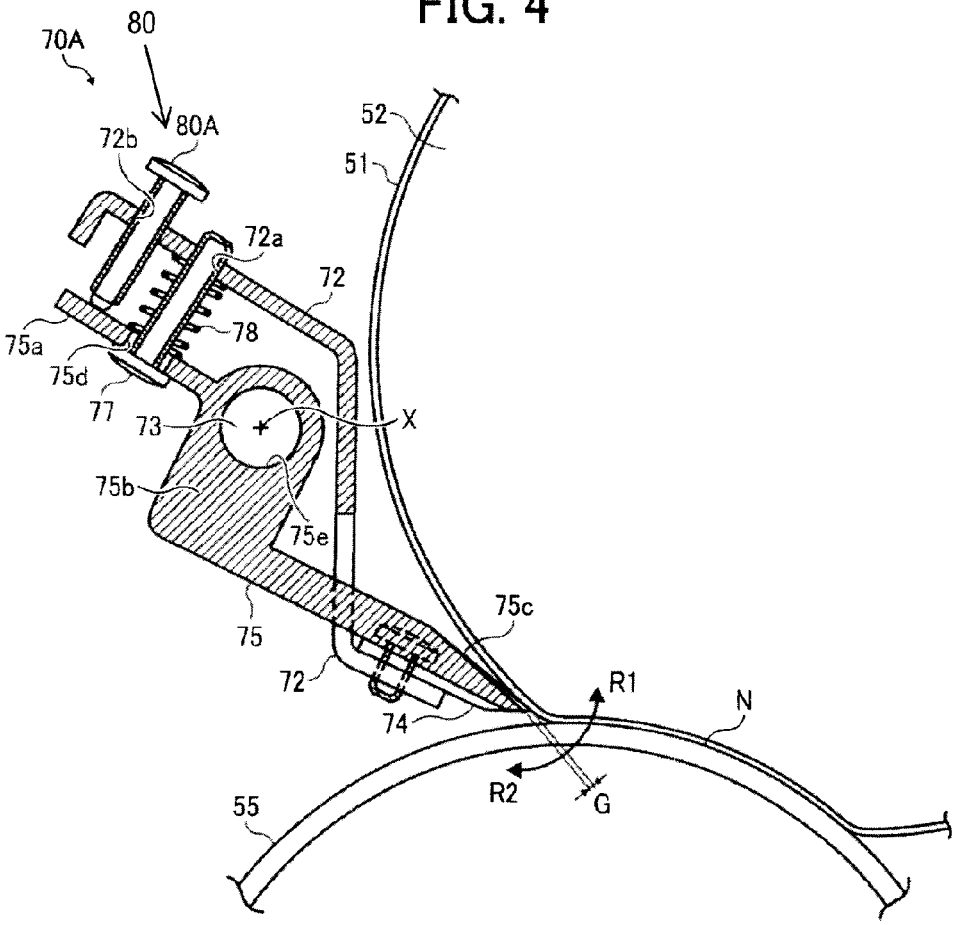
FIG. 4 is a sectional view of a sheet stripper mounted in the fixing device according to a first embodiment of this patent specification.

FIG. 4 is a sectional view of a sheet stripper 70A mounted in the fixing device 100 according to a first embodiment of this patent specification.

As shown in FIG. 4, the sheet stripper 70A includes the stripper finger 75 having a thin, operational edge thereof disposed adjacent to, and apart from, the rotary fuser belt 51 to strip the recording sheet S from the fuser belt 51. The stripper finger 75 is rotatable around a pivot axis X parallel to a rotation axis of the fuser belt 51 either in a first rotational direction (indicated by an arrow R1 in the drawing) in which the operational edge approaches the fuser belt 51, or in a second rotational direction (indicated by an arrow R2 in the drawing) in which the operational edge approaches the pressure roller 55, so as to establish an operational position thereof relative to the fuser belt 51.

In the present embodiment, the sheet stripper 70A is configured as a non-contact stripper with a spacing or gap G defined between the operational edge of the stripper finger 75 and the surface of the fuser belt 51 as the positioning flange 74 contacts and slides against the fuser belt 51. Also, the sheet stripper 70A includes a gap adjuster screw 77 interposed between the stripper finger 75 and the stay 72 to allow positioning the stripper finger 75 through rotation either in the first rotational direction R1 or in the second rotational direction R2, so as to adjust the width of finger-to-belt gap G during establishment of the operational position.

Figure 5:
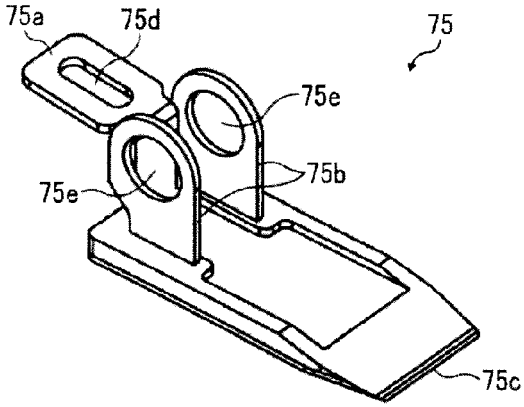
FIG. 5 is a perspective view of an example of a sheet stripper finger included in the sheet stripper.

FIG. 5 is a perspective view of an example of the sheet stripper finger 75 included in the sheet stripper 70A of FIG. 4.

As shown in FIG. 5, the stripper finger 75 comprises a tabbed base including a first, adjustment tab 75*a* defining an oval slot 75*d* for accommodating the gap adjuster screw 77 therein, and a pair of second, mounting tabs 75*b* each positioned generally perpendicular to the first tab 75*a* and defining a through-hole 75*e* for inserting the supporting shaft 73 therethrough, as well as a stripping tip 75*c* shaped to form a thin, operational edge, combined together with the first and second base tabs 75*a* and 75*b* to form a single, integrated structure.

The stripper finger 75 may be formed of fluorine resin, such as PFA, or alternatively, may have its operational edge and bottom side (i.e., the side facing a recording medium stripped off the rotary member) provided with a coating of such fluorine resin. Also, the stripper finger 75 may be obtained as a molded piece of a single material, or an insert-molded piece of different materials.

For example, the stripper finger 75 may have the first and second tabs 75*a* and 75*b* formed of a relatively rigid resin, and the stripping tip 75*c* formed of resin softer than that of the base tabs 75*a* and 75*b*, which are combined together through insert molding to form a composite structure of the tabbed base and the operational edge. Integrally forming the discrete parts of finger 75 through insert-molding allows for precise positioning of the stripping tip 75*c* relative to the base tabs 75*a* and 75*b* defining the slot 75*d* and the through-hole 75*e*, respectively, which leads to good stripping performance of the stripper finger 75 comparable to a stripper finger obtained through molding of a single material.

With further reference to FIG. 4, the stripper finger 75 is shown mounted by inserting the shaft 73 through the through-hole 75*e* of the mounting tab 75*b* to define the pivot axis X, with the stripping tip 75*c* forming the operational edge directed to the fixing nip N, and the adjustment tab 75*a* directed opposite the operational edge across the pivot axis X to face the stay 72.

The gap adjuster screw 77 has its proximal end inserted loosely (i.e., with spacing around the screw shank) into the slot 75*d* defined in the adjustment tab 75*a* of the stripper finger 75, and its distal end screwed into a first screw hole 72*a* defined in the stay 72. A compression spring 78 is provided around the screw shank between the stay 72 and the stripper finger 75, so as to elastically bias the stripper finger 75 in the first rotational direction R1 around the pivot axis X. The gap adjuster screw 77 loosely engaging the slot 75*d* may be tightened or loosened to adjust the position of the stripper finger 75 around the pivot axis X, which allows for fine tuning of the gap G between the operational edge of the stripper finger 75 and the surface of the fuser belt 51.

Specifically, loosening the screw 77 causes the stripper finger 75 to rotate around the pivot axis X in the first rotational direction R1 to reduce the finger-to-belt gap G whereas tightening the screw 77 causes the stripper finger 75 to rotate around the pivot axis X in the second rotational direction R2 to enlarge the finger-to-belt gap G.

Provision of the gap adjuster screw 77 to the sheet stripper 70A thus allows for fine tuning of the finger-to-belt gap G in the range of, for example, from approximately 0.1 mm to approximately 0.6 mm, which ensures good stripping performance of the non-contact stripping finger 75 comparable to, or even more effective than, that of a contact stripping finger. Further, maintaining the finger-to-belt gap G in an appropriate range reliably protects the fuser belt 51 from damage due to rubbing against the stripper finger 75, while reducing the risk of contaminating the stripper finger 75 with toner adherents, so that such adhesive toner, if present, does not retransfer or offset from the stripper finger 75 to the fuser belt 51, which would otherwise lead to imaging defects in a resulting print processed through the fixing nip N, as well as premature breakage of the fuser belt 51.

With continued reference to FIG. 4, the sheet stripper 70A is shown provided with a rotation restriction screw 80A disposed for contact with the stripper finger 75 to restrict rotation of the stripper finger 75 in the second rotational direction R2 upon establishment of the operational position of the stripper finger 75, thereby preventing the operational edge of the finger 75 from contacting the pressure roller 55.

Specifically, the rotation restriction screw 80A is inserted into a second screw hole 72*b* defined in the stay 72, which is located facing the adjustment tab 75*a* and farther from the stripping tip 75*c* than the first screw hole 72*a*, so that the screw 80 has its distal end in contact with the adjustment tab 75*a* without interfering the slot 75*d* accommodating the gap adjuster screw 77.

During assembly, the rotation restriction screw 80A remains loosened in the screw hole 72*b* of the stay 72 during adjustment of the finger-to-belt gap G through the gap adjustment screw 77. After gap adjustment, the screw 80A is screwed down toward the adjustment tab 75*a* of the stripper finger 75 until the distal end of the screw 80A becomes flush with the surface of the adjustment tab 75*a*.

In such a configuration, the rotation restricting screw 80A contacts the adjustment tab 75*a* to restrict rotation of the stripper finger 75 in the second rotational direction R2 around the pivot axis X, where the stripper finger 75 once set in the operational position is forced to rotate around the pivot axis X, for example, upon a recording sheet jamming the fixing nip N. Such rotation restriction capability prevents the finger-to-belt gap G from improperly enlarging, and prevents the stripper finger 75 from accidental contact with the pressure roller 55, which would otherwise result in damage to the pressure roller 55, particularly where the roller 55 has an outer circumferential surface formed of a soft, elastic material.

Figure 6:
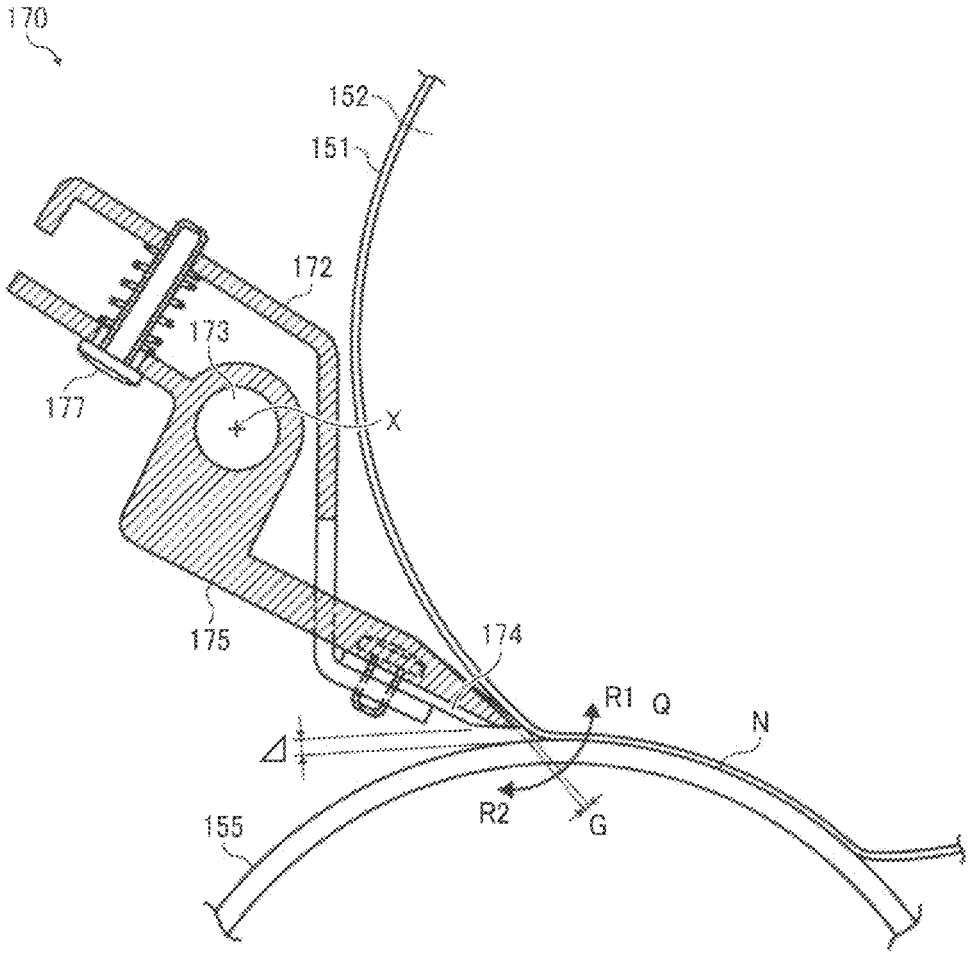
FIG. 6 is a sectional view of a sheet stripper mounted in the fixing device.

For comparison purposes and for facilitating an understanding of the sheet stripping mechanism according to this patent specification, consider a comparative example of sheet stripper 170 that does not have a rotation restriction mechanism with reference to FIG. 6.

As shown in FIG. 6, the overall configuration of the sheet stripper 170 is similar to that depicted above primarily with reference to FIG. 4, in which the sheet stripper 170, disposed downstream from a fixing nip N defined between a pair of rotary fixing members, one being a fuser belt 151 entrained around a fuser roller 152 and the other being a pressure roller 155 having an elastic, rubber-covered outer surface, includes a thin-edged, stripper finger 175 having an operational edge thereof spaced apart from the fuser belt 151 to strip a recording sheet S from the fuser belt 151, while rotatable either in a first rotational direction R1 or in a second rotational direction R2 around a shaft 173 supported on a stay 172 provided with a positioning flange 174 to define an edge-to-belt gap G which is adjustable through a spring-loaded, gap adjuster screw 177 disposed between the stripper finger 175 and the supporting stay 172, except that the sheet stripper 170 does not include a rotation restriction mechanism.

Although effectively protected against accidental contact between the stripper finger 175 and the fuser belt 151, the sheet stripper 170 occasionally fails to strip a recording sheet S from the fuser belt 151, which then wraps around the fuser belt 151 to cause a jam in the fixing nip N. In such cases, the recording sheet S enters between the fuser belt 151 and the stripper finger 175, thrusting against the finger operational edge to cause it to rotate around the pivot axis X in the second direction R2, and to eventually strike and damage the pressure roller 155.

The problem is particularly pronounced in high-speed, color printing application using a pair of relatively large rotary fixing members, typically larger than 50 mm in diameter, where the stripper finger 175 has its operational edge shaped into an extremely thin-wedged configuration and disposed as close as possible to the exit of the fixing nip N for preventing the outgoing sheet S from being excessively heated by prolonged contact with the fuser belt 151, which would otherwise result in imaging defects, such as orange-peel texture, blistering, excessive gloss, hot offset or undesired transfer of toner, and the like.

Not surprisingly, positioning the operational edge of the stripper finger 175 closer to the fixing nip N results in a reduced spacing Δ left between the finger operational edge and the pressure roller 155, which makes the finger operational edge susceptible to contact with the pressure roller 155 upon rotation of the stripper finger 175 in the second rotational direction R2. In particular, contact with the finger operational edge can cause a significant damage to the elastic surface of the pressure roller 155, where the finger operational edge is at a distance of 7 mm or shorter away from the exit of the fixing nip N with the opposed fixing rollers 152 and 155 both having a diameter of 80 mm or larger.

The problem encountered by the comparative example described above is effectively prevented in the sheet stripper 70 provided with the rotation restriction mechanism 80 according to this patent specification. That is, where a recording sheet S jamming between the fuser belt 51 and the stripper finger 75 thrusts against the finger operational edge to cause it to rotate around the pivot axis X, the rotation restriction screw 80 with its distal end contacting the adjustment tab 75*a* of the stripper finger 75 counteracts the rotational force to hinder rotation of the stripper finger 75 in the second rotational direction R2. Hence, provision of the rotation restriction mechanism 80 allows for secure operation of the sheet stripper 70, leading to high quality imaging performance of the fixing device 100 even in high-speed color printing applications.

Figure 7:
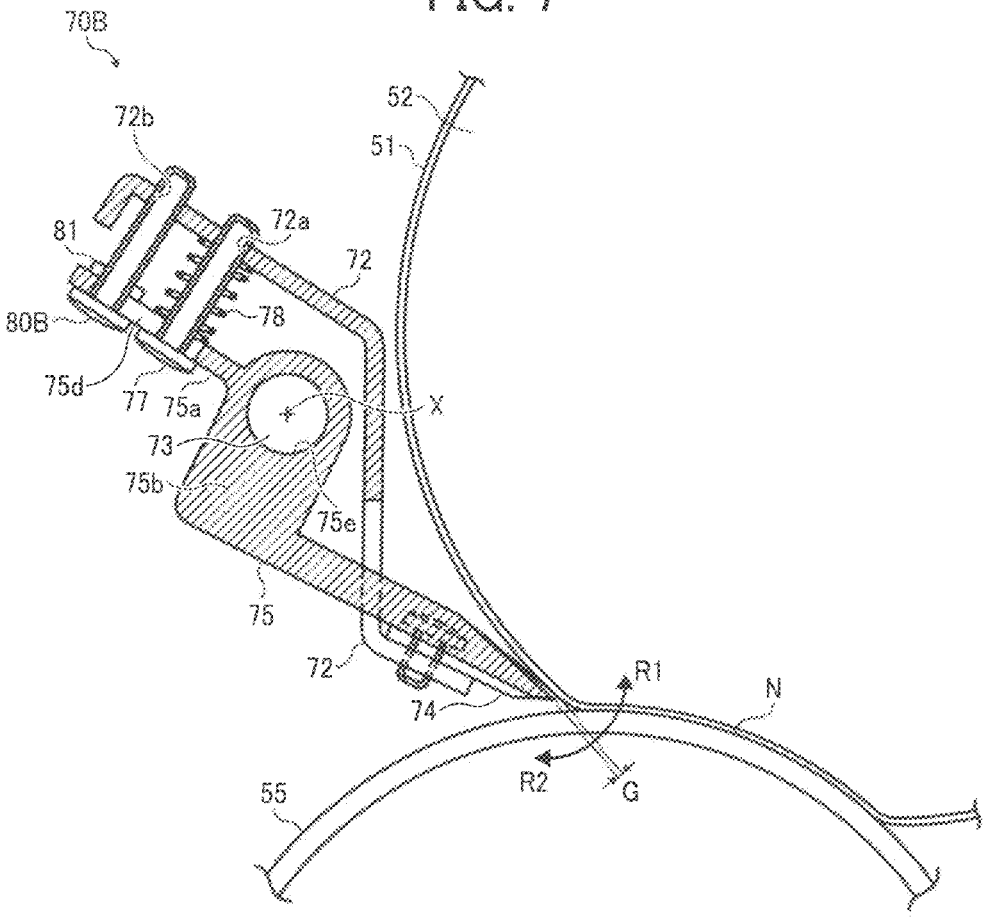
FIG. 7 is a sectional view of a sheet stripper mounted in the fixing device according to a second embodiment of this patent specification.

FIG. 7 is a sectional view of a sheet stripper 70B mounted in the fixing device 100 according to a second embodiment of this patent specification.

As shown in FIG. 7, the overall configuration of the sheet stripper 70B is similar to that of the first embodiment depicted above, except that the rotation restricting mechanism includes a screw or bolt 80B combined with a locking nut 81.

Specifically, the rotation restriction screw 80B has its proximal end inserted loosely (i.e., with spacing around the screw shank) into the slot 75*d* defined in the adjustment tab 75*a* of the stripper finger 75, and its distal end screwed into a second screw hole 72*b* defined in the stay 72, which is located facing the adjustment tab 75*a* and farther from the stripping tip 75*c* than the first screw hole 72*a*. The locking nut 81 is fitted on the shank of the rotation restriction screw 80B between the stay 72 and the stripper finger 75, so as to be driven toward the stay 72 when loosened, and toward the stripper finger 75 when tightened.

During assembly, the rotation restriction screw 80B is inserted into the screw hole 72*b* of the stay 72 with its locking nut 81 sufficiently loosened and not touching the stripper finger 75 during adjustment of the finger-to-belt gap G through the gap adjustment screw 77. After gap adjustment, the locking nut 81 is torqued down toward the adjustment tab 75*a* of the stripper finger 75 until it becomes flush with the surface of the base tab 75*a*, thereby retaining the screw 80B in place on the stripper finger 75.

In such a configuration, the rotation restricting screw 80B combined with the locking nut 81 contacts the adjustment tab 75*a* to restrict rotation of the stripper finger 75 in the second rotational direction R2 around the pivot axis X, where the stripper finger 75 once set in the operational position is forced to rotate around the pivot axis X, for example, upon a recording sheet jamming the fixing nip N. Such rotation restriction capability prevents the finger-to-belt gap G from improperly enlarging, and prevents the stripper finger 75 from accidental contact with the pressure roller 55, which would otherwise result in damage to the pressure roller 55, particularly where the roller 55 has an outer circumferential surface formed of a soft, elastic material.

In further embodiment, the sheet stripper 70B may be configured with a stripper finger that has a dedicated slot for accommodating the rotation restriction screw 80 instead of an oval slot accommodating both the rotation restriction screw 80 as well as the gap adjuster screw 77 therein. An example of such a sheet stripper finger 75 is depicted in FIG. 8.

Figure 8:
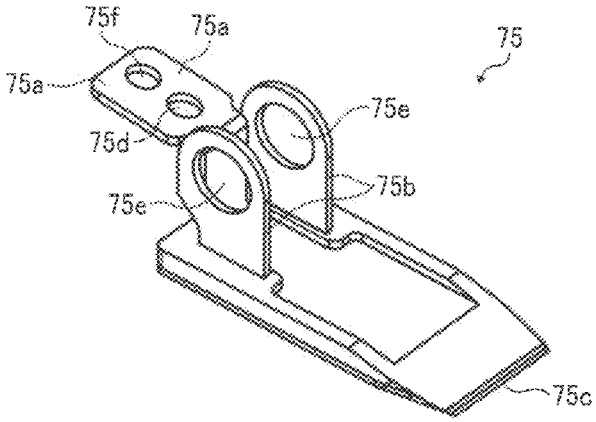
FIG. 8 is a perspective view of another example of a sheet stripper finger included in the sheet stripper.

As shown in FIG. 8, the stripper finger 75 comprises a tabbed base including a first, adjustment tab 75*a* defining a pair of first and second slots 75*d* and 75*f*, the former for accommodating the gap adjuster screw 77 and the latter for accommodating the rotation restriction screw 80 therein, and a pair of second, mounting tabs 75*b* each positioned generally perpendicular to the first tab 75*a* and defining a through-hole 75*e* for inserting the supporting shaft 73 therethrough, as well as a stripping tip 75*c* shaped to form a thin, operational edge, combined together with the first and second base tabs 75*a* and 75*b* to form a single, integrated structure. As is the case with the foregoing example, the stripper finger 75 may be a molded piece of fluorine resin, such as PFA, or alternatively, may have its operational edge and bottom side (i.e., the side facing a recording medium stripped off the rotary member) provided with a coating of such fluorine resin.

Figure 9:
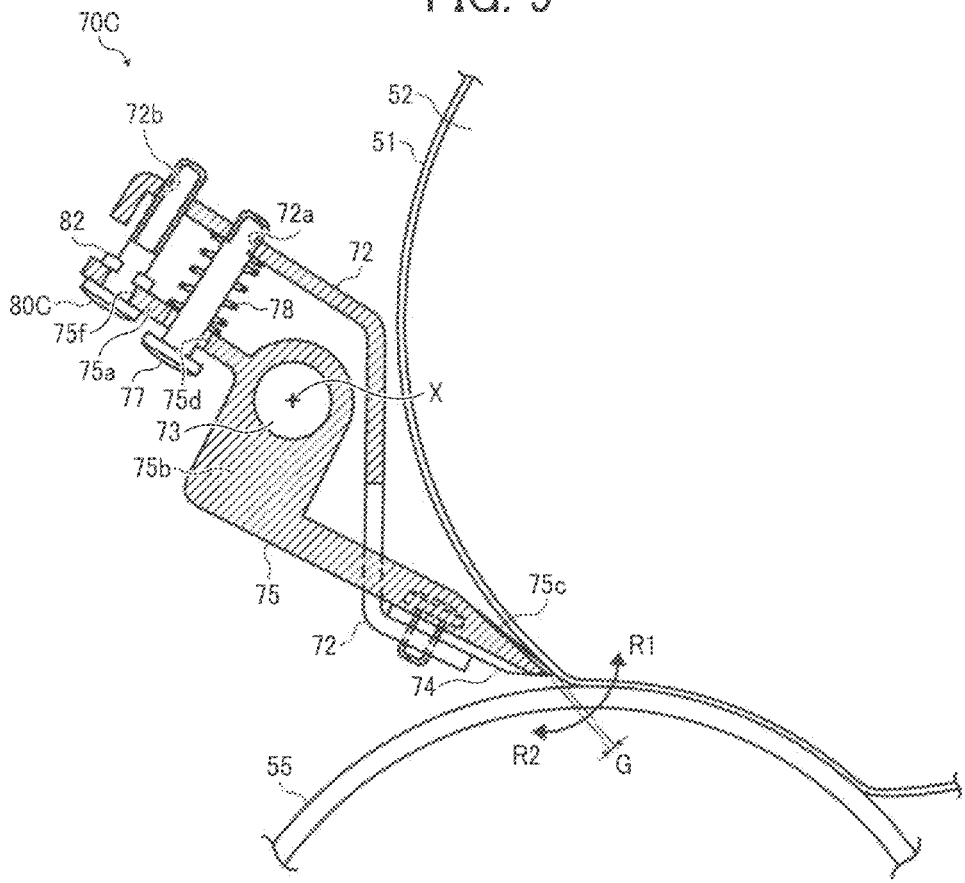
FIG. 9 is a sectional view of a sheet stripper mounted in the fixing device according to a third embodiment of this patent specification.

In these and other embodiments, the stripper finger 75 may have either of the configurations depicted in FIGS. 5 and 9, as well as any configuration other than those specifically described, depending on specific configuration of the sheet stripping mechanism.

FIG. 9 is a sectional view of a sheet stripper 70C mounted in the fixing device 100 according to a third embodiment of this patent specification.

As shown in FIG. 9, the overall configuration of the sheet stripper 70C is similar to that of the foregoing embodiments depicted above, except that the rotation restricting mechanism includes a specially shaped screw or bolt 80C combined with an E-ring 82.

Specifically, the rotation restriction screw 80C has its proximal end inserted loosely (i.e., with spacing around the screw shank) into the second slot 75*f* separate from the first slot 75*d* defined in the adjustment tab 75*a* of the stripper finger 75, and its distal end screwed into the second screw hole 72*b* defined in the stay 72, which is located facing the adjustment tab 75*a* and farther from the stripping tip 75*c* than the first screw hole 72*a*. The E-ring 82 is fitted on the shank of the rotation restriction screw 80C between the stay 72 and the stripper finger 75.

Figure 10A:
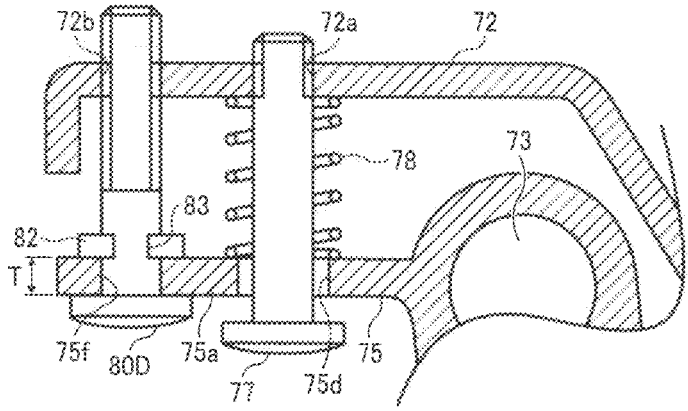
FIGS. 10A and 10B are enlarged sectional views illustrating an example of rotation restriction mechanism included in the sheet stripper of FIG. 9.
Figure 10B:
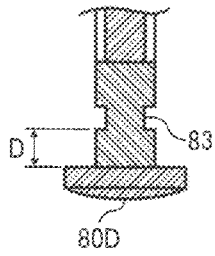

With additional reference to FIGS. 10A and 10B, more specifically, the rotation restriction screw 80C has its shank partially unthreaded and defining a recessed portion 83 adjacent to the proximal end for fitting the E-ring 82 therearound. The recessed portion 83 is located at a depth D from the screw head, substantially equal to a thickness T of the adjustment tab 75*a* of the stripper finger 75.

During assembly, the rotation restriction screw 80C is inserted into the screw hole 72*b* of the stay 72 without the E-ring 82 fitted therein, so that the screw 80C may move relative to the stripper finger 75 during adjustment of the finger-to-belt gap G through the gap adjustment screw 77. After gap adjustment, the screw 80C is screwed down toward the adjustment tab 75*a* of the stripper finger 75 until the head of the screw 80C becomes flush with the surface of the adjustment tab 75*a*. Then, the E-ring 82 is fitted in the recessed portion 83 of the screw 80C, so that the screw 80C no longer moves through the slot 75*f*, thereby retaining the screw 80C in place on the stripper finger 75.

In such a configuration, the rotation restricting screw 80C combined with the E-ring 83 contacts the adjustment tab 75*a* to restrict rotation of the stripper finger 75 in the second rotational direction R2 around the pivot axis X, where the stripper finger 75 once set in the operational position is forced to rotate around the pivot axis X, for example, upon a recording sheet jamming the fixing nip N. Such rotation restriction capability prevents the finger-to-belt gap G from improperly enlarging, and prevents the stripper finger 75 from accidental contact with the pressure roller 55, which would otherwise result in damage to the pressure roller 55, particularly where the roller 55 has an outer circumferential surface formed of a soft, elastic material.

Figure 11A:
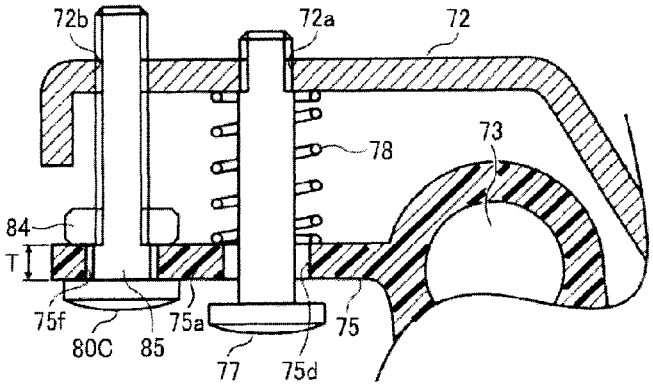
FIGS. 11A and 11B are enlarged sectional views illustrating another example of rotation restriction mechanism included in the sheet stripper of FIG. 9.
Figure 11B:
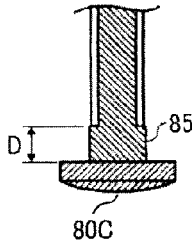

In further embodiment, instead of a partially recessed screw combined with an E-ring, the rotation restriction screw 80C may be configured as a shoulder screw or bolt combined with a locking nut, as shown in FIGS. 11A and 11B.

Specifically, the rotation restriction screw 80C has its shank threaded to fit a locking nut 84 therearound, while defining an unthreaded shoulder 85 at the proximal end larger in diameter than the threaded portion. The shoulder 85 has a depth D from the screw head, substantially equal to a thickness T of the adjustment tab 75*a* of the stripper finger 75.

During assembly, the rotation restriction screw 80C is inserted into the screw hole 72*b* of the stay 72 with its locking nut 84 loosened sufficiently, so that the screw 80C may move relative to the stripper finger 75 during adjustment of the finger-to-belt gap G through the gap adjustment screw 77. After gap adjustment, the screw 80C is screwed down toward the adjustment tab 75*a* of the stripper finger 75 until the head of the screw 80C becomes flush with the surface of the adjustment tab 75*a*. Then, the nut 84 is torqued down toward the stripper finger 75, so that the screw 80C no longer moves through the slot 75*f*, thereby retaining the screw 80C in place on the stripper finger 75.

In such a configuration, the rotation restricting screw 80C combined with the locking nut 84 contacts the adjustment tab 75*a* to restrict rotation of the stripper finger 75 in the second rotational direction R2 around the pivot axis X, where the stripper finger 75 once set in the operational position is forced to rotate around the pivot axis X, for example, by a recording sheet jamming the fixing nip N. Such rotation restriction capability prevents the finger-to-belt gap G from improperly enlarging, and prevents the stripper finger 75 from accidental contact with the pressure roller 55, which would otherwise result in damage to the pressure roller 55, particularly where the roller 55 has an outer circumferential surface formed of a soft, elastic material.

Hence, the rotation restriction mechanism 80 according to this patent specification effectively prevents failures due to contact between the stripper finger 75 and the pressure roller 55 upon establishment of the operational position of the stripper finger 75, wherein the rotation restriction member 80, such as a screw or bolt, provided on the supporting stay 72 of the stripper finger 75 contacts the adjustment tab 75*a* disposed opposite the operational edge across the pivot axis X of the stripper finger 75, so as to restrict rotation of the stripper finger 75 in the second rotational direction R2 around the pivot axis X.

Provision of the rotation restriction mechanism 80 allows for positioning the stripper finger extremely close to the exit of the fixing nip N, leading to secure, reliable performance of the sheet stripper 70 regardless of the type of recording sheet S in use. Further, restricting rotation of the stripper finger 75 by acting on the adjustment tab 75*a* apart from the operational edge enables the operational edge to be positioned within an extremely small space adjacent to the fixing nip N. Furthermore, the rotation restriction member 80 provided on the supporting stay 72 can be positioned extremely close to the stripper finger 75, so as to effectively act on the stripper finger 75 even where the sheet stripper 70 has a compact design with a reduced size of the stripper finger 75. Moreover, use of inexpensive components, such as a screw or bolt, with or without a retaining member, as a rotation restrictor allows for low-cost production of the fixing device 100 incorporating the rotation restriction mechanism 80.

Although in the embodiments described above, the rotation restriction mechanism 80 employs a rotation restriction member provided on the supporting stay 72 of the stripper finger 75, alternatively, instead, it is possible to provide the rotation restriction member to the enclosure housing 100*a* of the fixing member 100 which accommodates the rotary fixing members 51 and 55. Several such embodiments are described below with reference to FIGS. 12 and 13.

Figure 12:
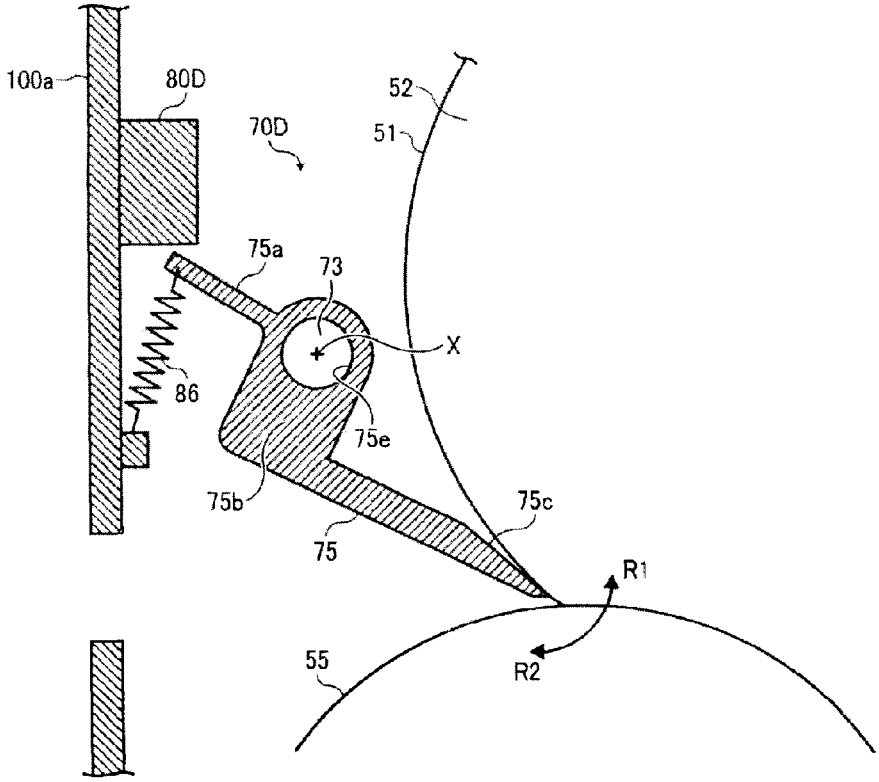
FIG. 12 is a sectional view of a sheet stripper mounted in the fixing device according to a fourth embodiment of this patent specification.

FIG. 12 is a sectional view of a sheet stripper 70D mounted in the fixing device 100 according to a fourth embodiment of this patent specification.

As shown in FIG. 12, the overall configuration of the sheet stripper 70D is similar to that of the foregoing embodiments depicted above, except that the rotation restricting mechanism includes a stationary flange 80D affixed to the enclosure housing 100*a* of the fixing device 100, facing the adjustment tab 75*a* of the stripper finger 75.

Unlike the foregoing embodiments, the sheet stripper 70D is configured as a non-contact stripper, i.e., with no spacing between the operational edge of the stripper finger 75 and the surface of the fuser belt 51, wherein a tension spring 86 is disposed between the enclosure housing 100*a* of the fixing device 100 and the adjustment tab 75*a* of the stripper finger 75 to bias the stripper finger 75 in the first rotational direction R1, so as to press the finger operational edge against the fuser belt 51.

The rotation restriction flange 80D is spaced apart from the adjustment tab 75*a* where the stripper finger 75 is in position, which allows the stripper finger 75 to rotate by a limited amount in the second rotational direction R2 around the pivot axis X. This amount of rotation does not exceed an amount of rotation required to bring the operational edge of the stripper finger 75 into contact with the pressure roller 55.

In such a configuration, the rotation restricting flange 80D, normally spaced apart from the adjustment tab 75*a*, contacts the adjustment tab 75*a* to stop rotation of the stripper finger 75 in the second rotational direction R2 around the pivot axis X, where the stripper finger 75 once set in the operational position is forced to rotate by the limited amount around the pivot axis X, for example, upon a recording sheet jamming the fixing nip N. Such rotation restriction capability prevents the stripper finger 75 from accidental contact with the pressure roller 55, which would otherwise result in damage to the pressure roller 55, particularly where the roller 55 has an outer circumferential surface formed of a soft, elastic material.

Figure 13:
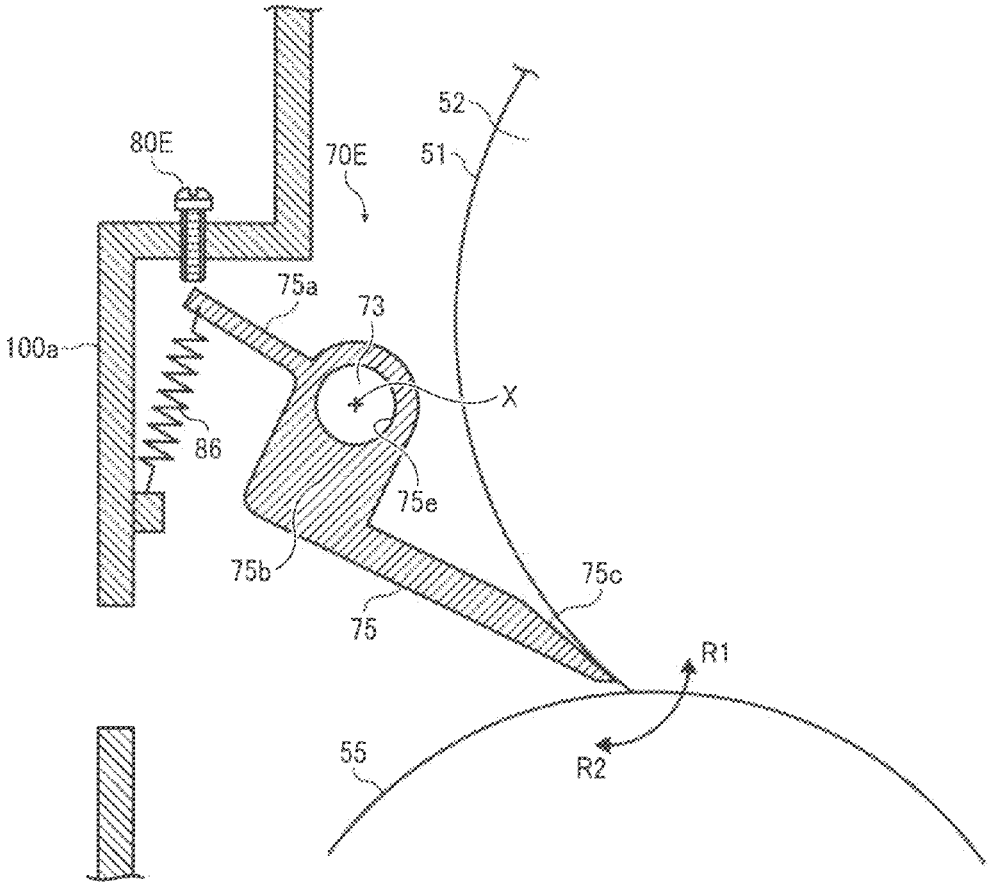
FIG. 13 is a sectional view of a sheet stripper mounted in the fixing device according to a fifth embodiment of this patent specification.

FIG. 13 is a sectional view of a sheet stripper 70E mounted in the fixing device 100 according to a fifth embodiment of this patent specification.

As shown in FIG. 13, the overall configuration of the sheet stripper 70E is similar to that of the foregoing embodiments depicted above, except that the rotation restricting mechanism includes a positionable screw 80E screwed onto the enclosure housing 100*a* of the fixing device 100, facing the adjustment tab 75*a* of the stripper finger 75.

As is the case with the fourth embodiment, the sheet stripper 70E is configured as a non-contact stripper, i.e., with no spacing between the operational edge of the stripper finger 75 and the surface of the fuser belt 51, wherein a tension spring 86 is disposed between the enclosure housing 100*a* of the fixing device 100 and the adjustment tab 75*a* of the stripper finger 75 to bias the stripper finger 75 in the first rotational direction R1, so as to press the finger operational edge against the fuser belt 51.

During assembly, the rotation restriction screw 80E is screwed into position spaced apart from the adjustment tab 75*a* where the stripper finger 75 is in position, which allows the stripper finger 75 to rotate by a limited amount in the second rotational direction R2 around the pivot axis X. This amount of rotation does not exceed an amount of rotation required to bring the operational edge of the stripper finger 75 into contact with the pressure roller 55.

In such a configuration, the rotation restricting screw 80E, normally spaced apart from the adjustment tab 75*a*, contacts the adjustment tab 75*a* to stop rotation of the stripper finger 75 in the second rotational direction R2 around the pivot axis X, where the stripper finger 75 once set in the operational position is forced to rotate by the limited amount around the pivot axis X, for example, upon a recording sheet jamming the fixing nip N. Such rotation restriction capability prevents the stripper finger 75 from accidental contact with the pressure roller 55, which would otherwise result in damage to the pressure roller 55, particularly where the roller 55 has an outer circumferential surface formed of a soft, elastic material.

Hence, the rotation restriction mechanism 80 according to this patent specification effectively prevents failures due to contact between the stripper finger 75 and the pressure roller 55 upon establishment of the operational position of the stripper finger 75, wherein the rotation restriction member 80, such as a stationary flange or positionable screw, provided on the enclosure housing 100*a* of the fixing device 100 contacts the adjustment tab 75*a* disposed opposite the operational edge across the pivot axis X of the stripper finger 75, so as to restrict rotation of the stripper finger 75 in the second rotational direction R2 around the pivot axis X.

In addition to various beneficial effects described earlier, providing the rotation restriction member 80, either stationary or positionable, on the enclosure housing 100*a* of the fixing device 100 allows for a simple configuration of the rotation restriction mechanism 70 as well as a compact, inexpensive design of the fixing device 100 incorporating the rotation restriction mechanism 70. Although the sheet stripper 70 in the fourth and fifth embodiments is configured as a contact sheet stripper, the rotation restriction flange and screw 70D and 70E may work with a non-contact sheet stripper, such as those described in the foregoing embodiments.

To recapitulate, the media stripper 70 according to this patent specification is used where a pair of first and second opposed rotary members 51 and 55 disposed opposite each other forms a nip N therebetween through which a recording medium S is conveyed as the rotary members 51 and 55 rotate together.

The media stripper 70 includes a stripper finger 75 and a rotation restriction mechanism 80. The media stripper 70 has an operational edge thereof disposed adjacent to the first rotary member 51 to strip the recording medium S from the first rotary member 51. The stripper finger 75 is rotatable around a pivot axis X parallel to a rotation axis of the first rotary member 51 either in a first rotational direction R1 in which the operational edge approaches the first rotary member 51, or in a second rotational direction R2 in which the operational edge approaches the second rotary member 55, so as to establish an operational position thereof relative to the first rotary member 51. The rotation restriction mechanism 80 is disposed for contact with the stripper finger 75 to restrict rotation of the stripper finger 75 in the second rotational direction R2 upon establishment of the operational position of the stripper finger 75.

Although in several embodiments depicted above, the media stripper 70 is used in a fixing device that employs a pair of rotary fixing members forming a fixing nip therebetween, instead, the media stripping mechanism according to this patent specification may be used with any media conveyance device that includes a pair of opposed rotary members disposed opposite each other to form a nip therebetween through which a recording medium is conveyed as the rotary members rotate together.

Also, although in several embodiments depicted above, the fixing device is configured as a belt-based assembly including an endless, rotary fuser belt paired with a rotary pressure roller, the media stripping mechanism according to this patent specification may be applicable to any type of fixing device that includes a pair of rotary fuser and pressure members disposed opposite to each other to form a fixing nip therebetween.

Further, although in several embodiments depicted above, the image forming apparatus is configured as a tandem color printer that employs four imaging stations arranged sequentially along an intermediate transfer belt, alternatively, instead, the media stripping mechanism according to this patent specification may be applicable to any type of imaging system that includes a pair of opposed rotary members disposed opposite to each other to form a nip therebetween, in particular, one that incorporates a fixing capability to fix a toner image in place on a recording medium conveyed thorough a fixing nip.

For example, the printer section may employ any number of imaging stations or primary colors associated therewith, e.g., a full-color process with three primary colors, a bi-color process with two primary colors, or a monochrome process with a single primary color. The order in which the multiple imaging stations are arranged sequentially along the intermediate transfer belt may be different than that depicted herein.

Further, instead of a tandem printing system, the printing section may employ any suitable imaging process for producing a toner image on a recording medium, such as one that employs a single photoconductor surrounded by multiple development devices for different primary colors, or one that employs a photoconductor in conjunction with a rotary or revolver development system rotatable relative to the photoconductive surface.

Furthermore, the image forming apparatus according to this patent specification may be applicable to any type of electrophotographic imaging systems, such as photocopiers, printers, facsimiles, and multifunctional machines incorporating several of such imaging functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A media stripper for use with a pair of first and second, opposed rotary members disposed opposite each other to form a nip therebetween through which a recording medium is conveyed as the rotary members rotate together, the media stripper comprising:

a stripper finger having an operational edge thereof disposed adjacent to the first rotary member to strip the recording medium from the first rotary member, the stripper finger being rotatable around a pivot axis parallel to a rotation axis of the first rotary member either in a first rotational direction in which the operational edge approaches the first rotary member, or in a second rotational direction in which the operational edge approaches the second rotary member, so as to establish an operational position thereof relative to the first rotary member; and a rotation restriction mechanism disposed for contact with the stripper finger to restrict rotation of the stripper finger in the second rotational direction upon establishment of the operational position of the stripper finger, wherein the stripper finger includes an adjustment tab disposed opposite the operational edge across the pivot axis, and wherein the rotation restriction mechanism contacts the adjustment tab of the stripper finger for restricting rotation of the stripper finger in the second rotational direction.

2. The media stripper according to claim 1, wherein the stripper finger is at least partially formed of fluorine resin.

3. The media stripper according to claim 1, wherein the stripper finger is at least partially coated with fluorine resin.

4. A fixing device, comprising: a media stripper according to claim 1.

5. An image forming apparatus, comprising: a media stripper according to claim 1.

6. A media stripper for use with a pair of first and second, opposed rotary members disposed opposite each other to form a nip therebetween through which a recording medium is conveyed as the rotary members rotate together, the media stripper comprising:

a stripper finger having an operational edge thereof disposed adjacent to the first rotary member to strip the recording medium from the first rotary member, the stripper finger being rotatable around a pivot axis parallel to a rotation axis of the first rotary member either in a first rotational direction in which the operational edge approaches the first rotary member, or in a second rotational direction in which the operational edge approaches the second rotary member, so as to establish an operational position thereof relative to the first rotary member;

a rotation restriction mechanism disposed for contact with the stripper finger to restrict rotation of the stripper finger in the second rotational direction upon establishment of the operational position of the stripper finger;

an elongated shaft connected to the stripper finger to define the pivot axis;

an elongated stay extending along the first rotary member while connected to the shaft to support the stripper finger in position relative to the first rotary member; and a pair of positioning flanges disposed at opposed longitudinal ends of the stay to contact the first rotary member outboard of a width of the recording medium, so as to form a gap between the operational edge and the first rotary member upon establishment of the operational position of the stripper finger.

7. The media stripper according to claim 6, further comprising:

a gap adjuster interposed between the stripper finger and the stay to allow positioning the stripper finger through rotation either in the first rotational direction or in the second rotational direction, so as to adjust a width of the gap between the operational edge of the stripper finger and the first rotary member.

8. The media stripper according to claim 6, wherein the stripper finger includes an adjustment tab disposed opposite the operational edge across the pivot axis, the rotation restriction mechanism is provided on the stay to contact the adjustment tab for restricting rotation of the stripper finger in the second rotational direction.

9. The media stripper according to claim 6, wherein the rotation restriction mechanism includes:

a screw having a proximal end thereof loosely engaging the stripper finger, and a distal end thereof screwed into the stay; and a screw retainer disposed around the screw proximal end to retain the screw in contact with the stripper finger for restricting rotation of the stripper finger in the second rotational direction.

10. The media stripper according to claim 9, wherein the screw retainer is releasable to allow the stripper finger to rotate in the second rotational direction before establishment of the operational position of the stripper finger.

11. A fixing device, comprising: a media stripper according to claim 6.

12. An image forming apparatus, comprising: a media stripper according to claim 6.

13. A media stripper for use with a pair of first and second, opposed rotary members disposed opposite each other to form a nip therebetween through which a recording medium is conveyed as the rotary members rotate together, the media stripper comprising:

a stripper finger having an operational edge thereof disposed adjacent to the first rotary member to strip the recording medium from the first rotary member, the stripper finger being rotatable around a pivot axis parallel to a rotation axis of the first rotary member either in a first rotational direction in which the operational edge approaches the first rotary member, or in a second rotational direction in which the operational edge approaches the second rotary member, so as to establish an operational position thereof relative to the first rotary member; and a rotation restriction mechanism disposed for contact with the stripper finger to restrict rotation of the stripper finger in the second rotational direction upon establishment of the operational position of the stripper finger, wherein the stripper finger includes an adjustment tab disposed opposite the operational edge across the pivot axis, and wherein the rotation restriction mechanism is provided on a housing accommodating the first and second rotary members to contact the adjustment tab for restricting rotation of the stripper finger in the second rotational direction.

14. The media stripper according to claim 13, wherein the rotation restriction mechanism comprises a stationary flange affixed to the housing accommodating the first and second rotary members.

15. The media stripper according to claim 13, wherein the rotation restriction mechanism comprises a positionable member adjustably affixed to the housing accommodating the first and second rotary members.

16. The media stripper according to claim 13, wherein the rotation restriction mechanism is spaced apart from the adjustment tab to allow the stripper finger to rotate in the second rotational direction by a limited amount upon establishment of the operational position of the stripper finger.

17. The media stripper according to claim 16, wherein the limited amount of rotation does not exceed an amount of rotation required to bring the operational edge of the stripper finger into contact with the second rotary member.

18. A fixing device, comprising: a media stripper according to claim 13.

19. An image forming apparatus, comprising: a media stripper according to claim 13.

* * * * *